US005295676A

United States Patent [19]

Kenin et al.

[11] Patent Number: 5,295,676

[45] Date of Patent: Mar. 22, 1994

[54] SHEET FEEDING APPARATUS

[75] Inventors: Michael Kenin, Rochester; David P. Dworzanski, Walworth; Donald S. Hensel, Rochester; Raymond M. Quackenbush, Hilton, all of N.Y.

[73] Assignee: Eastman Kodak Company, Rochester, N.Y.

[21] Appl. No.: 976,609

[22] Filed: Nov. 16, 1992

[51] Int. Cl.[5] ..... B65H 3/12

[52] U.S. Cl. ..... 271/94; 271/99

[58] Field of Search ..... 271/94, 112, 35, 34, 271/99, 11

[56] References Cited

U.S. PATENT DOCUMENTS

| | | | |
|---|---|---|---|
| 3,570,843 | 3/1971 | Keulen et al. | 271/35 X |
| 4,181,298 | 1/1980 | Capdeboscq | 271/5 |
| 4,236,708 | 12/1980 | Matsuo | 271/12 |
| 4,270,746 | 6/1981 | Hamlin | 271/35 X |
| 4,355,796 | 10/1982 | Day | 271/20 |
| 4,462,586 | 7/1984 | Browne et al. | 271/94 |
| 4,595,190 | 6/1986 | Amarakoon | 271/94 |
| 4,627,606 | 12/1986 | Moore | 271/98 |
| 4,632,377 | 12/1986 | Browse | 271/9 |
| 4,844,435 | 7/1989 | Giannetti et al. | 271/35 X |

*Primary Examiner*—David H. Bollinger

*Attorney, Agent, or Firm*—Lawrence P. Kessler

[57] ABSTRACT

Apparatus for feeding material, in the form of discrete sheets, seriatim from a stack of discrete sheets. The sheet feeding apparatus comprises a support for a stack of discrete sheets. A sheet in the supported stack of discrete sheets is engaged by a friction mechanism for selectively removing such sheet from the stack. Such sheet is attracted to the friction mechanism by vacuum directed adjacent to the friction mechanism. The vacuum attraction increases the force of engagement of such sheet with the friction mechanism to facilitate removal of such sheet from the stack of discrete sheets by the friction mechanism.

6 Claims, 2 Drawing Sheets

SHEET FEEDING APPARATUS

BACKGROUND OF THE INVENTION

The present invention relates in general to sheet feeding apparatus, and more particularly, to a friction sheet feeding apparatus including a vacuum assist mechanism to improve the overall reliability of the sheet feeding apparatus.

Modern reproduction equipment, such as copiers or printers or the like, are capable of operating at very high speeds. In order to assure that the equipment functions in a manner to reliably produce desired copies of original information, such equipment must include sheet feeding apparatus for handling original information-containing document sheets and sheets of receiver material for rapid, reliable transport through the equipment. The sheet feeding apparatus must operate to feed sheets at the necessary high transport speeds without damage to the sheets, and with a maximum of stoppages due to misfeeds or multifeeds.

Sheet feeding apparatus for carrying out the desired high speed reliable transport typically employ either friction or vacuum feeding devices for separating individual sheets from a sheet stack for transport through the reproduction equipment. Friction sheet feeders utilize a friction member to scuff a sheet to remove such sheet from the top or bottom of a stack of sheets. On the other hand, vacuum feeding devices include a member which attracts the top or bottom sheet from a sheet stack by application of vacuum forces to the member. The member, and the attracted sheet, is then moved to remove the sheet from the stack.

While both friction and vacuum type feeding devices can be designed to be generally reliable, each have certain inherent inadequacies. Particularly, friction devices are highly dependent upon the frictional characteristics of the material being fed. It is therefore difficult to design a single friction feed device which can, without substantial adjustment, accommodate reliably all the different materials used as original sheets or receiver materials which the reproduction equipment may have to handle. On the other hand, vacuum devices are highly dependent on other characteristics of the material being fed, such as their weight or porosity for example. Such devices require significant control mechanisms to provide optimum vacuum to reliably feed single sheets without misfeeds or multifeeds.

SUMMARY OF THE INVENTION

In view of the foregoing discussion, this invention is directed to a friction sheet feeding apparatus including a vacuum assist mechanism to improve the overall reliability of the sheet feeding apparatus. The sheet feeding apparatus comprises a support for a stack of discrete sheets. A sheet in the supported stack of discrete sheets is engaged by a friction mechanism for selectively removing such sheet from the stack. Such sheet is attracted to the friction mechanism by vacuum directed adjacent to the friction mechanism. The vacuum attraction increases the force of engagement of such sheet with the friction mechanism to facilitate removal of such sheet from the stack of discrete sheets by the friction mechanism.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
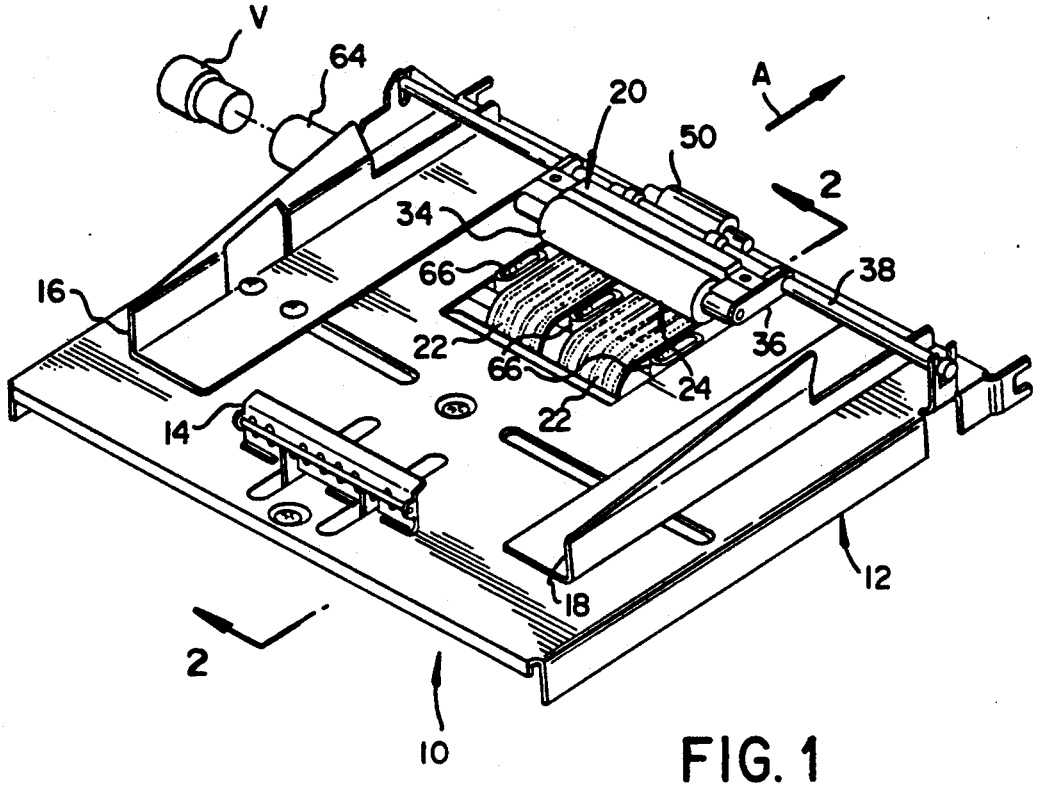
FIG. 1 is a view, in perspective, of the sheet feeding apparatus according to this invention.
Figure 2:
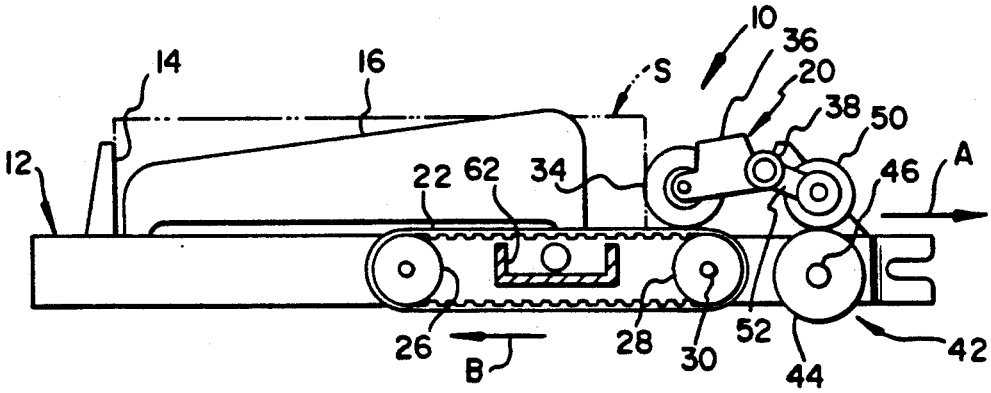
FIG. 2 is a side elevational view of the sheet feeding apparatus according to this invention, partly in cross-section taken along the lines 2—2 of FIG. 1, and with portions removed to facilitate viewing.
Figure 3:
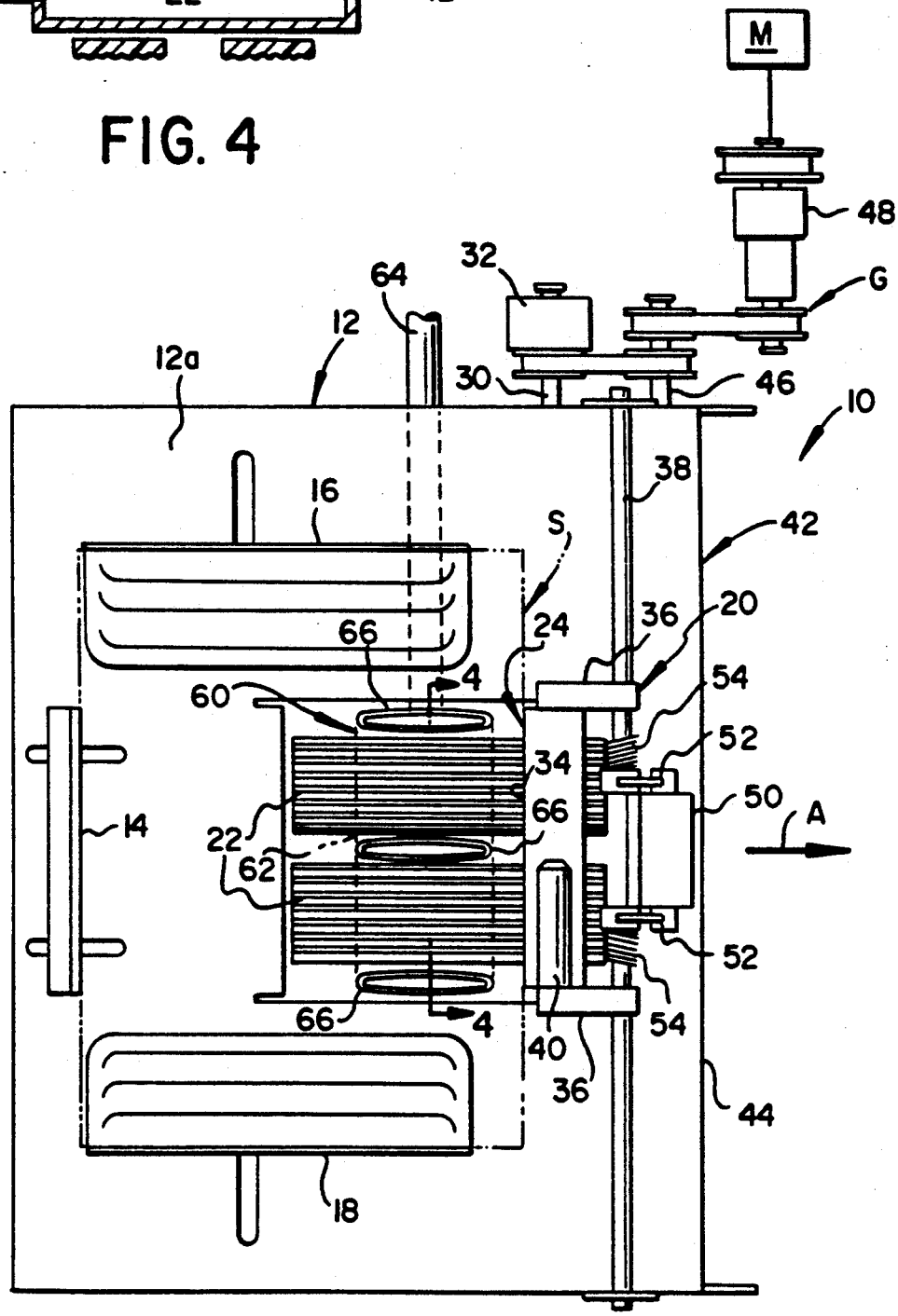
FIG. 3 is a top plan view of the sheet feeding apparatus of FIG. 1 with portions removed or broken away to facilitate viewing.

Referring now to the accompanying drawings, the FIGS. 1-3 show an improved apparatus for feeding discrete sheets, for example of receiver material for a reproduction machine, according to this invention, designated generally by the numeral 10. The sheet feeder 10 is shown as an improvement of a bottom scuff feeding apparatus of the general type shown and fully described in U.S. patent application Ser. No. 855,966, filed Mar. 23, 1992, in the name of Shea et al. This Application can be referred to for a detailed description of the basic bottom scuff sheet feeder and its operation. Such sheet feeder is discussed hereinbelow in sufficient detail for a full understanding of the advantageous modifications to the basic apparatus provided by this invention. Of course, this invention is suitable for use with other sheet feeding apparatus such as any well known bottom or top scuff type sheet feeders.

The sheet feeder 10 includes a tray 12 and a scuff feed mechanism 20, associated with the tray, for feeding discrete sheets seriatim from the tray in the direction of arrow A. The tray 12 has a substantially planar surface **12*a* upon which a stack of sheets S (shown in phantom lines in FIGS. 2 and 3) may be located. The opposed marginal edges of the sheet stack S, in the crosstrack direction relative to the sheet feed direction, are bounded by side guides 16, and 18. The rear marginal edge of the sheet stack is bounded by an end guide 14. The side guides 16, 18 and the end guide 14 are adjustable, in any well known manner, in order to accommodate sheet stacks of various dimensions. Adjustably setting the location of the side guides and end guide maintains the respective loaded sheet stacks in a desired position on the surface 12*a* of the tray 12 relative to the scuff feed mechanism 20**.

The scuff feed mechanism 20 includes scuff feed belts 22 and a retard device 24. The scuff feed belts 22 are drivingly entrained about rollers 26, 28 located to establish a run for the scuff feed belts positioned above the level of the surface **12*a* of the tray 12 (see FIG. 2) to substantially support the sheet stack S. Roller 28 is mounted on a shaft 30 coupled through a clutch 32 (and a pulley and belt arrangement G shown in FIG. 3) to a motor M for selective rotation of the shaft. When it is desired to feed a sheet from the stack S, the scuff feed belts 22 are driven in the direction of arrow B, about the closed loop path defined by the rollers 26 and 28, by energizing the clutch 32 to connect the shaft 30** to the motor M.

The retard device 24, for preventing multisheet feeds, includes a retard roller 34 supported by arms 36. The arms 36 are, in turn, supported for pivotable movement about a shaft 38 located downstream, in the direction of sheet travel, of the retard roller 34 and above the plane of the surface 12*a* of the tray 12. The retard roller 34, which normally rests on the scuff feed belts 22, engages the lead marginal edge of the sheet stack S and forms a separation nip with the scuff feed belt. An internal brake 40, associated with the retard roller 34, prevents rotation of the retard roller when one or more sheets enter the nip between the retard roller and the scuff feed belts 22, but permits rotation of the retard roller when no sheets are in such nip.

A sheet transport device 42 is located immediately downstream, in the direction of sheet feed, from the separation nip formed by the scuff feed belts 22 and the retard roller 34. The sheet transport device 42 includes a drive roller 44 mounted on a shaft 46. The shaft 46 is coupled through a clutch 48, and the pulley and belt arrangement G, to a motor (for example, motor M). Selective activation of the clutch 48 provides for rotation of the shaft, and thus selective rotation of the drive roller 44. A roller 50 is supported by arms 52, which are in turn supported for pivotable movement about the shaft 38. Spring members 54 urge the arms 52 in a direction (clockwise in FIG. 2) such that the roller 50 forms a feed nip with the roller 44.

The purpose of the feed nip between the roller 50 and the drive roller 44 is to effect transport of a sheet removed from the sheet stack S by the scuff feed belts 22 away from the tray 12 in the direction of arrow A. That is, when a sheet is removed from the stack S by the scuff feed belts 22 and forwarded to the feed nip, the clutch 48 is activated to cause the drive roller 44 to rotate and transport the sheet away from the tray 12. The surface velocity of the drive roller 44 is selected to be slightly greater than the surface velocity of the scuff feed belts 22. As such, a separated sheet is sped up on entering the nip between the drive roller 44 and the roller 50. This assures removal of the sheet from the separation nip between the scuff feed belts 22 and the retard roller 34, thereby further preventing any misfeeds (multifeeds) of sheets from the stack S in the tray 12.

Figure 4:
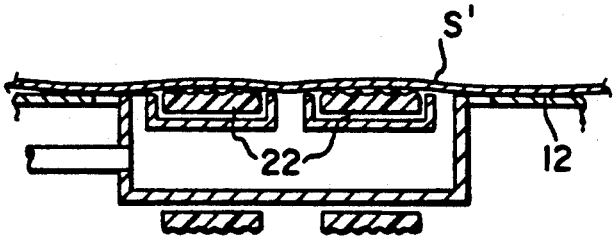
FIG. 4 is an end elevational view of the sheet feeding apparatus according to this invention, partly in cross-section taken along the lines 4—4 of FIG. 3, and with portions removed to facilitate viewing.

While the above described bottom sheet feeding apparatus 10 has proven highly reliable in feeding discrete sheets seriatim from the supported stack, its performance has been markedly improved by the addition of the vacuum mechanism 60 according to this invention. The vacuum mechanism 60 incudes a plenum 62 located within the cavity formed by the scuff feed belts 22 (see FIG. 4). One end of the plenum is connected by a conduit 64 to a vacuum source V. A plurality of elongated ports 66 are formed in the plenum 62 and are located so as to be adjacent to the belts 22. The direction of elongation of the ports 66 runs parallel to the direction of travel of the scuff feed belts 22.

Application of vacuum to the plenum 62 of the vacuum mechanism 60 acts through the elongated ports 66 to urge the bottommost sheet in the stack S into engagement with the scuff feed belts 22. This increases the normal forces between the sheet and the scuff feed belts, and results in a concomitant increase in the friction force therebetween. Therefore, the ability to feed a discrete sheet from the sheet stack is enhanced. Moreover, friction feeding of each discrete sheet is accomplished with substantially no slippage between the sheet and the scuff feed belts. This reduction in slippage is a significant aspect of this invention in that slippage of the sheet is a prime cause of water of the belts, and may damage the sheets as they are fed. Accordingly, the reliability of the improved sheet feeder 10 is markedly increased.

A further advantage of the incorporation of the vacuum mechanism 60 according to this invention is that it serves to both reduce curl in the sheets and causes the sheets to assume a slightly corrugated shape. The elimination of sheet curl prevents sheet misfeeds by straightening out the sheets adjacent to their respective marginal edges to eliminate the potential for curled corners to interfere with various structural elements of the sheet feeding apparatus. Meanwhile, the slight corrugation of the sheet attracted to the scuff feed belts by the vacuum mechanism 60 minimizes multifeeds by providing for a separation between adjacent sheets.

The invention has been described in detail with particular reference to preferred embodiment thereof, but it will be understood that variations and modifications can be effected within the spirit and scope of the invention as set forth in the claims.

What is claimed is:

1. Apparatus for feeding material, in the form of discrete sheets, seriatim from a stack of discrete sheets, said apparatus comprising:

means for supporting a stack of discrete sheets;

at least one scuff feed belt frictionally engaging a sheet of a stack of discrete sheets supported by said stack supporting means, said at least one scuff feed belt movable in a direction for selectively removing such sheet from said stack of discrete sheets; and vacuum means, located adjacent to said at least one scuff feed belt, for attracting a sheet from said stack of discrete sheets to increase the force of engagement of such sheet with said at least one scuff feed belt to facilitate removal of such sheet from said stack of discrete sheets by said sheet engaging means, said vacuum means including a vacuum source, a plenum defining a plurality of ports located adjacent to each marginal edge of said at least one scuff feed belt, and means for communicating said vacuum source with said plenum.

2. The feeding apparatus of claim 1 wherein said sheet engaging means includes a plurality of scuff feed felts located in spaced in a parallel relation.

3. The feeding apparatus of claim 2 wherein said plenum defines a plurality of ports located adjacent to each of the marginal edges of said plurality of scuff feed belts.

4. The feeding apparatus of claim 3 wherein said ports defined by said plenum are elongated in a direction parallel to the direction of movement of said plurality of scuff feed belts.

5. The feeding apparatus of claim 2 wherein said sheet stack supporting means includes a substantially planar member upon which a sheet stack is located for support; and wherein said plurality of scuff feed belts are located so as to have a run extending above said planar member to support the bottommost sheet of a sheet stack thereon.

6. The feeding apparatus of claim 5 wherein said plurality of scuff feed belts are movable about a closed loop path; and wherein said plenum of said vacuum means is located substantially within said closed loop path of said plurality of scuff feed belts.

* * * * *